US005704498A

United States Patent [19]

Smith et al.

[11] Patent Number: 5,704,498

[45] Date of Patent: Jan. 6, 1998

[54] TRANSPORTABLE CRANE

[75] Inventors: John Kirk Smith, Waynesboro, Pa.; Ramesh Purushottam Patel, Hagerstown, Md.; Henry David Barthalow, Greencastle, Pa.

[73] Assignee: Kidde Industries, Inc., Iselin, N.J.

[21] Appl. No.: 774,200

[22] Filed: Dec. 27, 1996

Related U.S. Application Data

[60] Provisional application No. 60/026,607.

[51] Int. Cl.[6] ..... B66C 23/04

[52] U.S. Cl. ..... 212/231; 212/300

[58] Field of Search ..... 52/118; 212/177, 212/230, 231, 296, 298, 299, 300

[56] References Cited

U.S. PATENT DOCUMENTS

| | | | |
|---|---|---|---|
| D. 190,990 | 8/1961 | Shook et al. . | |
| D. 272,955 | 3/1984 | Dowrick et al. . | |
| D. 283,072 | 3/1986 | Qureshi et al. . | |
| D. 335,740 | 5/1993 | Fujimoto et al. . | |
| 3,262,517 | 7/1966 | Malec . | |
| 3,557,969 | 1/1971 | Heyer | 212/177 |
| 3,572,517 | 3/1971 | Leibherr et al. . | |
| 3,584,703 | 6/1971 | Lane . | |
| 3,604,533 | 9/1971 | Eckels . | |
| 3,631,988 | 1/1972 | Noly . | |
| 3,831,771 | 8/1974 | Wiencek | 212/230 |
| 3,891,056 | 6/1975 | Ashworth . | |
| 4,187,927 | 2/1980 | Byrne . | |
| 4,296,833 | 10/1981 | Ashworth . | |
| 4,660,731 | 4/1987 | Becker . | |
| 4,679,653 | 7/1987 | Pasquarette, Jr. et al. . | |
| 4,775,029 | 10/1988 | MacDonald et al. . | |
| 4,925,039 | 5/1990 | Macris . | |
| 5,249,643 | 10/1993 | Backer et al. . | |
| 5,307,898 | 5/1994 | Purdy et al. . | |
| 5,597,078 | 1/1997 | Becker et al. | 212/299 |

*Primary Examiner*—Thomas J. Brahan

[57] ABSTRACT

A transportable multi-purpose crane includes a platform having outriggers disposed at opposite ends thereof. A turntable is rotatably mounted to the platform between the outriggers on opposite ends of the platform, and has a center axis of rotation. A riser boom, having a first end and a second end, is pivotally mounted to the turntable at its first end, and the second end supports a first load carrying device. The riser boom points in a first direction with respect to the center axis of rotation, and is a telescoping boom. An upper boom, having a first end and a second end, has its first end pivotally mounted to the second end of the riser boom. The second end of the upper boom supports a second load carrying device. The upper boom points in a second direction, opposite the first direction, with respect to the center axis of rotation, and is a telescoping boom. By providing the riser boom and the upper boom such that the riser boom serves as a counterweight when the second load carrying device carries a load and such that the upper boom serves as a counterweight when the first load carrying device carries a load, the crane does not need a separate counterweight.

33 Claims, 13 Drawing Sheets

TRANSPORTABLE CRANE

This application claims priority on provisional application Ser. No. 60/026,607, filed on Sep. 25, 1996, the entire contents of which are hereby incorporated by reference.

BACKGROUND OF THE INVENTION

1. Field of the Invention

The present invention relates to a transportable telescopic boom crane having improved up and over capabilities, and/or which does not need a counterweight.

2. Description of Related Art

At almost any work site a crane can be seen lifting heavy loads to dizzying heights. The use of a mobile telescopic boom crane, however, can present many logistical problems for even the most skilled construction crew. Problems arise with respect to getting the crane to the work site, and whether or not the crane chosen can perform the assigned task once at the work site. For instance, take the classic up and over lift illustrated in FIG. 1. As shown in FIG. 1, construction is ongoing at a building, and a load of materials has to be lifted from the ground to the top of the building.

Several factors play an important role in deciding the size of the crane needed to perform this up and over lift. Those factors include the lift height, the boom length, the lift radius, space constraints, and the mass of the load. The lift height is the height to which the load must be lifted, and directly influences the height the boom must achieve to make the lift. Accordingly, lift height also influences the boom length needed to make the lift. The lift radius is the distance between the load and the crane during the lift. As one skilled in the art knows, the further the load is from the crane, the heavier the crane needed so that the crane does not tip over during the lift. Lift radius also influences the boom length.

As our cities and towns have become more and more crowded, the factor of space constraints has increased in importance. Space constraints tends to directly influence the lift radius and the boom length. For instance, suppose that the space constraints at a particular work site prohibit placing the crane near the load. Viewed another way, the crane needed to perform the lift, even if placed near the load, is too large for the space available near the load. Accordingly, the crane will have to be positioned further from the load causing an increase in the lift radius, and thus, requiring a larger crane to perform the lift. Furthermore, obstacles may restrict movement of the boom resulting in an increase in both the lift radius and boom length. As with the lift radius, the greater the boom length, the larger the crane, which has a longer boom, needed to perform the lift.

Cranes are given a standardized rating in tons based on their lifting capabilities. For instance, a 100 ton telescopic boom crane can lift 100 tons with the telescopic boom fully retracted at a minimum rated radius, while a 1 ton crane can lift 1 ton with the boom fully retracted at a minimum rated radius.

As further examples, suppose 10 tons are to be lifted 100 feet, 75 feet and 40 feet at a radius of 10 feet from the crane. To perform the 100 foot lift would require a conventional 100 ton crane, to perform the 75 foot lift would request a conventional 50 ton crane, and to perform the 40 foot lift would require a conventional 25 ton crane.

Returning to the up and over lift illustrated in FIG. 1, a load on one side of a building needs to be lifted to the top of the building. As shown in FIG. 1, the building is 40 feet tall and 60 feet wide. Due to space constraints, however, the crane must be positioned on the opposite side of the building from the load; hence the name up and over lift.

FIG. 1 also illustrates the other type of space constraint, the building. The building places a restriction on the placement of the boom during the lift. Namely, the crane must be placed a specified distance from the building in order for the boom to clear the top edge of the building during the lift. Accordingly, the boom height is greatly increased. To perform the up and over lift of FIG. 1 using the conventional crane illustrated, requires at least a 70 ton crane. Only a conventional crane of this size has a long enough boom structure to make the lift. Depending on the load or if a different type of conventional crane is used; an even larger crane might be required.

Furthermore, the space constraints which prohibited positioning the crane on the same side of the building as the load may exist all the way around the building. As a result, the crane may have to be positioned even further from the load requiring an even larger crane to perform the lift. Additionally, conventional cranes require a counterweight to prevent them from tipping over. The larger the load to be lifted and/or the greater the lifting radius, the larger the counterweight needed and/or the further from the platform the counterweight must be disposed, albeit still connected thereto. Accordingly, the amount the counterweight is disposed away from the platform (i.e., the tail swing) can contribute greatly to the amount of space required for proper operation of the crane.

Having chosen a crane large enough to perform the lift, the construction crew is now faced with the problem of getting the crane to the work site. In a best case scenario, the crane is simply driven to the work site. Unfortunately, various laws exist which regulate loads placed on the roadways. Accordingly, while a 70 ton crane is needed to perform the lift, the roadways leading to the work site may only permit, at most, a 50 ton crane to travel thereon. Furthermore, conditions at the work site itself may not support such a large crane.

Conventional cranes have significant tail swings and limited boom configurations. As such construction crews typically experience many of the problems discussed above when using a conventional crane to perform an up and over lift.

FIGS. 2*a*–4 are schematic drawings illustrating different conventional multiple boom crane configurations which suffer from one or more of the above discussed draw backs. FIGS. 2*a* and 2*b* represent the transportable crane described in U.S. Pat. No. 3,572,517 to Liebherr. As shown in FIG. 2*a*, the Liebherr crane includes a rotary platform 2 mounted on a chassis 20. The chassis 20 is supported by outriggers 4 on either end. Pivotally connected to the platform 2 is a telescoping mast 6 which supports a load carrying hook 18. A hydraulic cylinder 10 elevates the telescoping mast 6. Disposed on top of the telescoping mast 6 is a jib 8. A movable counterweight 16 is disposed at an end of the platform 2 to prevent the crane from tipping. The counterweight 16 is movable with respect to the platform 2, and is moved further from the platform 2 to increase the counterweighting effect.

FIG. 2*b* illustrates another use of the transportable crane disclosed by Liebherr. In this configuration, the hydraulic cylinder 10 positions the mast 6 perpendicular with respect to the platform 2 to form a rotary tower crane. A sheave and cable system 12 in combination with the extension of telescoping mast 6 is then used to pivot the jib 8 relative to the vertical mast 6. As shown in FIG. 2b, the jib 8 supports a load carrying hook 14. In the Liebherr crane, the jib 8 can only be used to support a load via the load carrying hook 14 when the mast 6 is disposed vertical to the platform 2.

FIG. 3 illustrates another multiple boom conventional crane configuration. This crane configuration was used in the up and over lift example of FIG. 1. As shown in FIG. 3, this crane includes a platform 30 supported by outriggers 32. A first telescoping boom 34 has a first end pivotally mounted to the platform 30. The first boom 34 points towards a first end of the platform 30, and is elevated by a hydraulic cylinder 38. A second telescoping boom 36 is pivotally connected to a second end of the first boom 34. The second boom 36 also points towards the first end of the platform 30 as the first boom 34, and is elevated relative to the first boom 30 by a hydraulic cylinder 40. The second boom 36 supports a load carrying hook 42. To prevent the crane from tipping over, a counterweight 44 is disposed at the second end of the platform 30.

FIG. 4 illustrates the crane of FIG. 3 with the first boom 34 elevated to achieve a maximum elevation with respect to the platform 30.

SUMMARY OF THE INVENTION

One object of the present invention is to provide a crane which overcomes the numerous drawbacks discussed above with respect to conventional cranes.

Another object of the present invention is to provide a crane having an improved up and over lifting capability.

A further object of the present invention is to provide a crane having a reduced or no tail swing.

An additional object of the present invention is to provide a crane which does not need a counterweight.

These and other related objects of the present invention are achieved by providing a transportable multi-purpose crane, comprising: a platform having outriggers disposed at opposite ends; a turntable rotatably mounted to said platform between said outriggers on opposite ends of said platform and having a center axis of rotation; a riser boom having a first end and a second end, said first end being pivotally mounted to said turntable, said second end supporting a first load carrying means, said riser boom pointing in a first direction with respect to said center of rotation, said riser boom being a telescoping boom; an upper boom having a first end and a second end, said first end being pivotally mounted to said second end of said riser boom, said second end supporting a second load carrying means, said upper boom pointing in a second direction, opposite said first direction, with respect to said center of rotation, said upper boom being a telescoping boom.

These and other related objects by providing said riser boom and said upper boom such that said riser boom serves as a counterweight when said second load carrying means carries a load and said upper boom serves as a counterweight when said first load carrying means carries a load such that the crane does not need a separate counterweight.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 5:
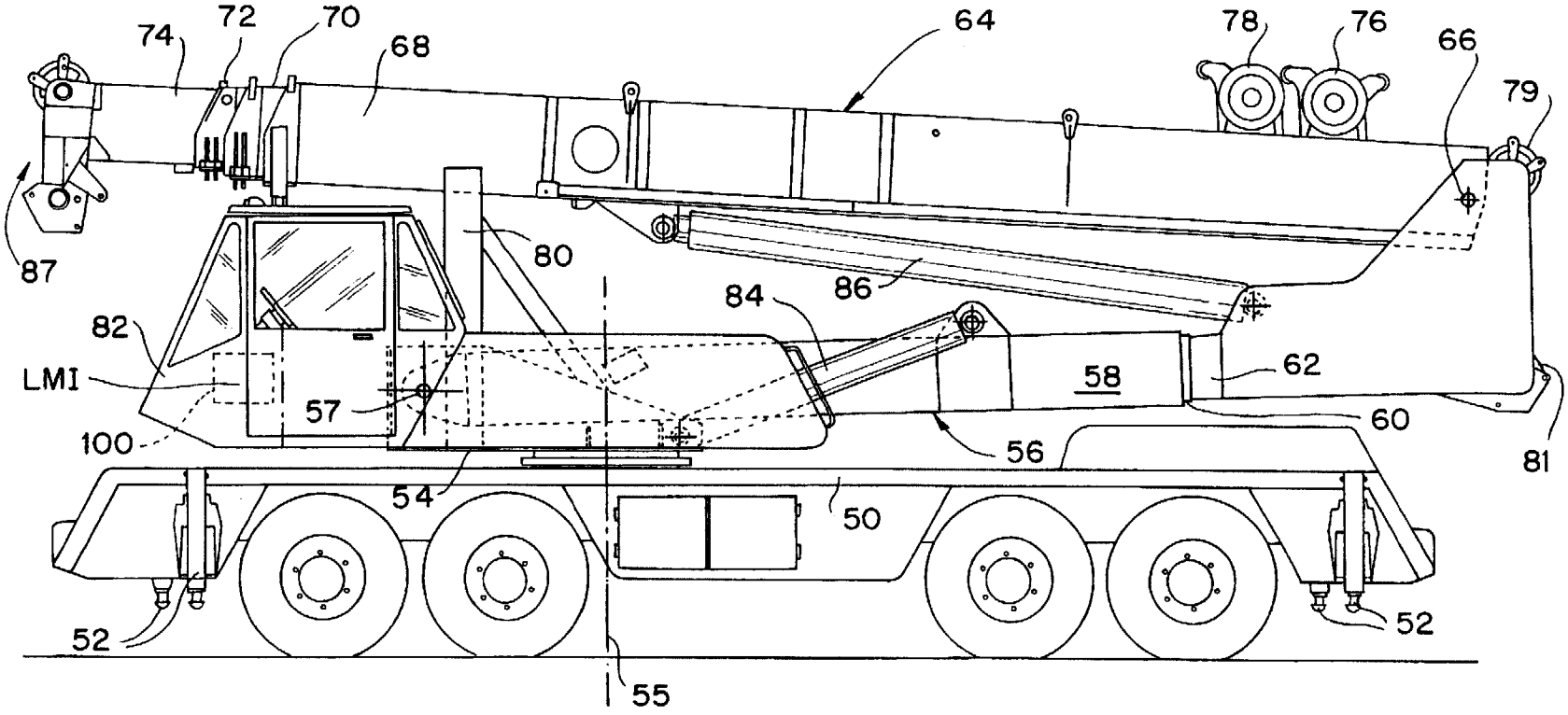
FIG. 5 illustrates a side view of the crane according to the present invention.
Figure 7:
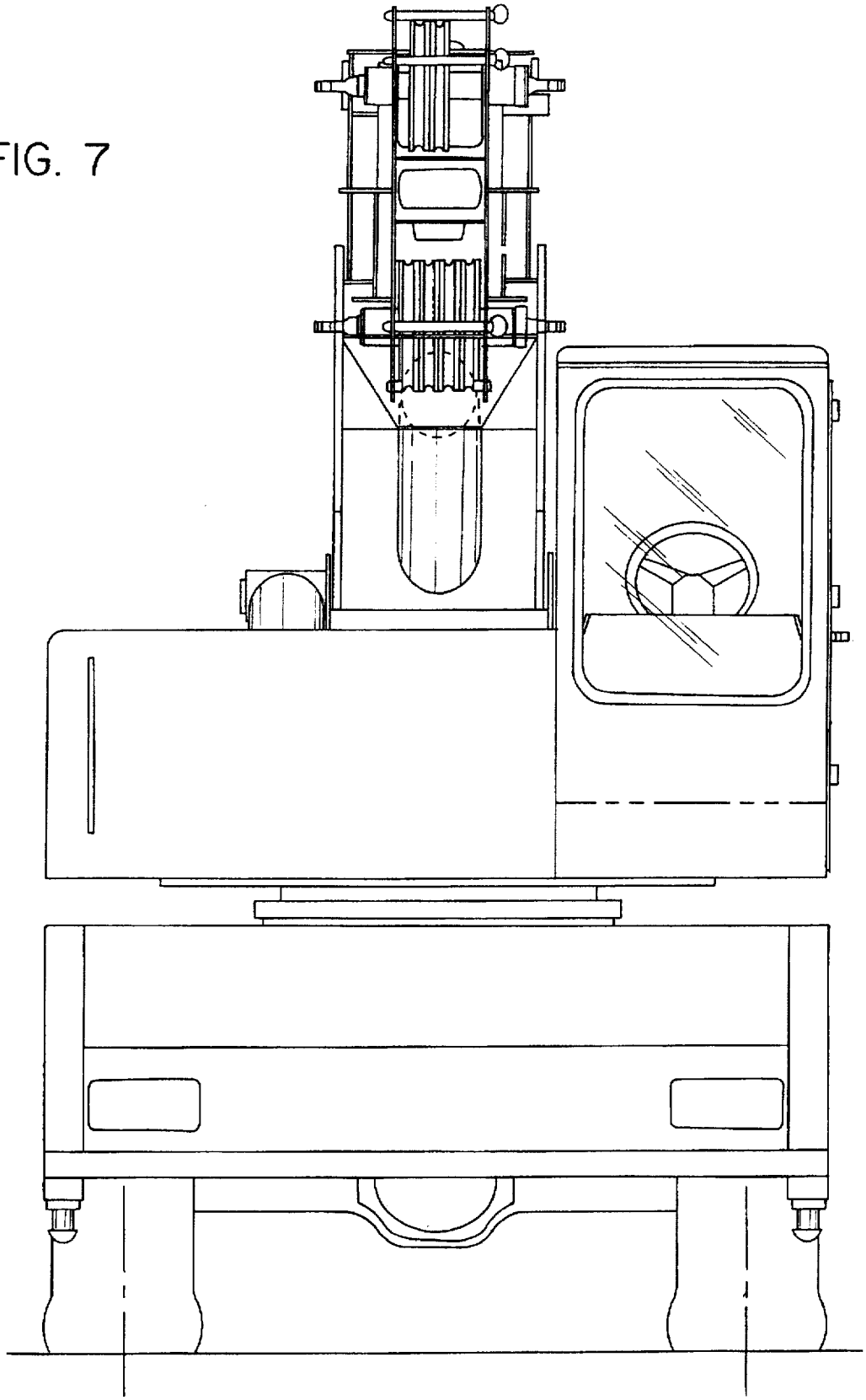
FIGS. 7–9 illustrate a front, rear and top view, respectively, of the crane according to the present invention.
Figure 8:
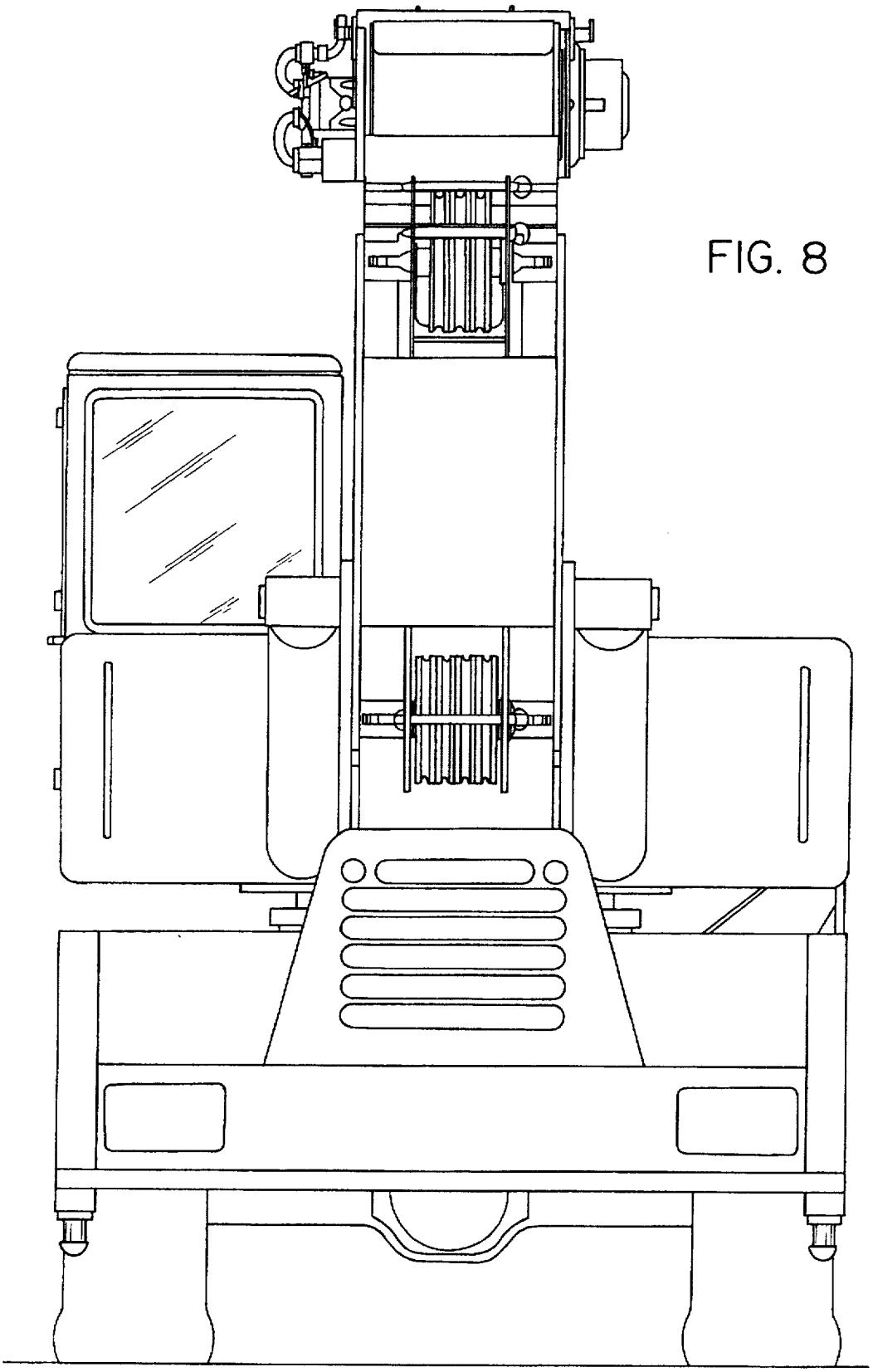
Figure 9:
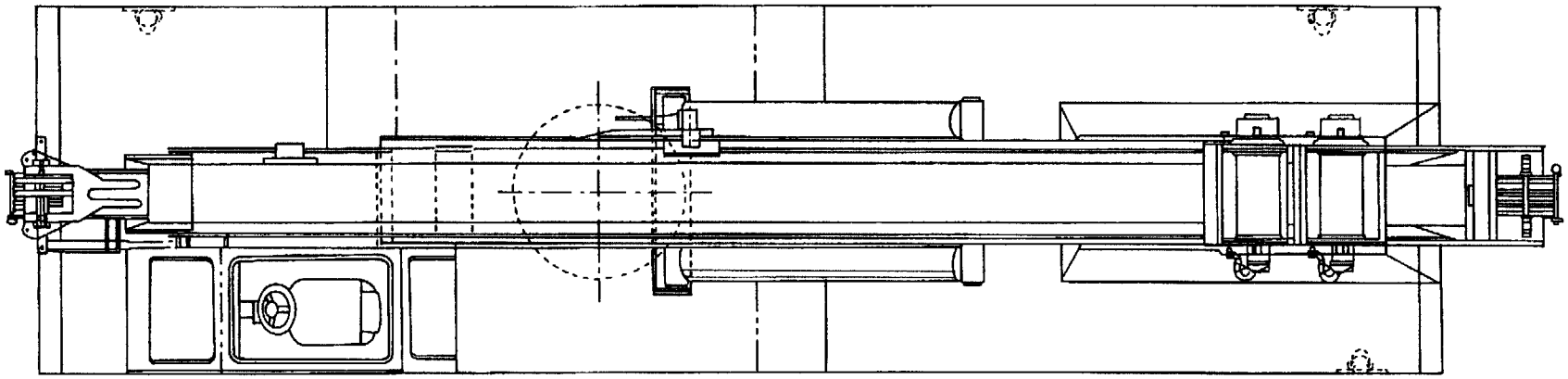

FIG. 5 illustrates a side view of the crane accordingly to the present invention, and FIGS. 7, 8 and 9 illustrate front, rear and top views, respectively, of the crane according to the present invention. Referring to FIG. 5, the crane includes a chassis 50 having front and rear extendable and retractable outriggers 52. When the crane reaches a work site, the outriggers 52 are deployed to lift the chassis 50 off the ground and to level the chassis 50.

A turntable 54 is rotatably mounted to the chassis 50, and has a center axis of rotation 55. A riser boom 56 is pivotally mounted to the turntable 54 at a riser boom pivot connection 57, and extends or points in one direction with respect to the center axis of rotation 55. One skilled in the art will recognize from the disclosure, that the pivot connection 57 could be made on the other side of the center axis of rotation. The riser boom 56 is a multi-section telescoping boom having a base section 58, a mid section 60 and a fly section 62. A riser boom elevation or lift cylinder 84 connected between the turntable 54 and the riser boom 56 controls the elevation of the riser boom 56. The riser boom 56 also includes a telescoping mechanism as illustrated in FIG. 6A; whereby the various boom sections are telescopically movable relative to each other by hydraulic cylinder/piston assemblies mounted inside the riser boom 56 between the respective boom sections, in a conventional manner, or by other conventional boom extension mechanisms.

Figure 6A:
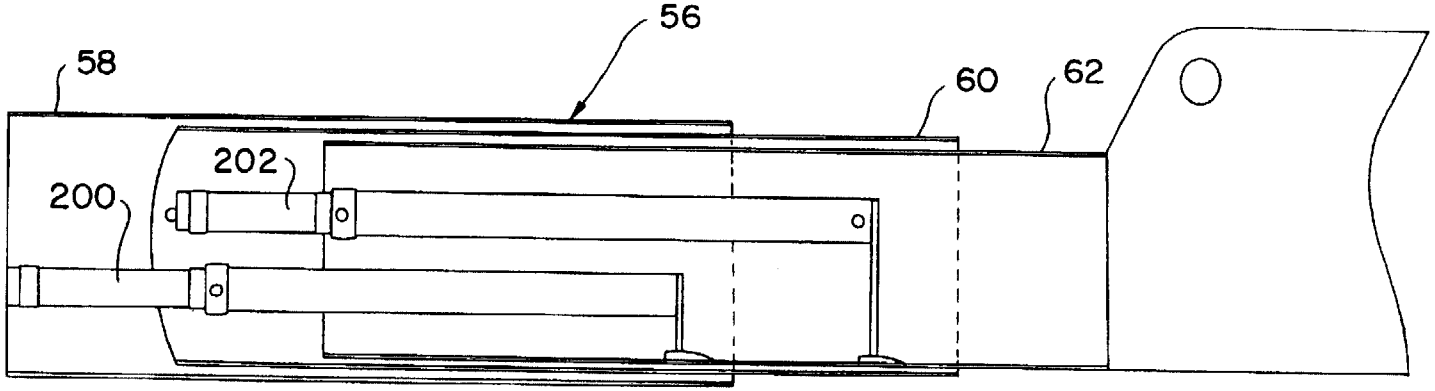
FIGS. 6A and 6B illustrate the telescoping mechanisms for the riser boom and upper boom, respectively, of the crane according to the present invention.

As shown in FIG. 6A, the telescoping mechanism for the riser boom 56 includes a first single stage telescoping cylinder 200 and a second single stage telescoping cylinder 202. The first telescoping cylinder is connected to the base section 58 and the mid section 60. The second telescoping cylinder 202 is connected to the mid section 60 and the fly section 62. During operation, the first telescoping cylinder 200 extends and retracts to extend and retract the mid section 60. The second telescoping cylinder 202 extends and retracts to extend and retract the fly section 62.

An upper boom 64 is pivotally connected to the riser boom 56 at an upper boom pivot connection 66, and points in the opposite direction that the riser boom 56 points with respect to the center axis of rotation 55. As discussed in more detail below, the riser boom 56 and the upper boom 64 will point in opposite directions with respect to the center axis of rotation 55. Furthermore, the upper boom 64 and the riser boom 56 have an in-line relation. A boom rest 80, mounted on turntable 54, supports the upper boom 64 when both the upper boom 64 and the riser boom 56 are in their respective stowed positions. The upper boom 64 is a multi-section telescoping boom having a base section 68, an inner mid section 70, an outer mid section 72, and a fly section 74. An upper boom elevation or lift cylinder 86 connected between the upper boom 64 and the riser boom 56 controls the elevation of the upper boom 64.

Figure 6B:
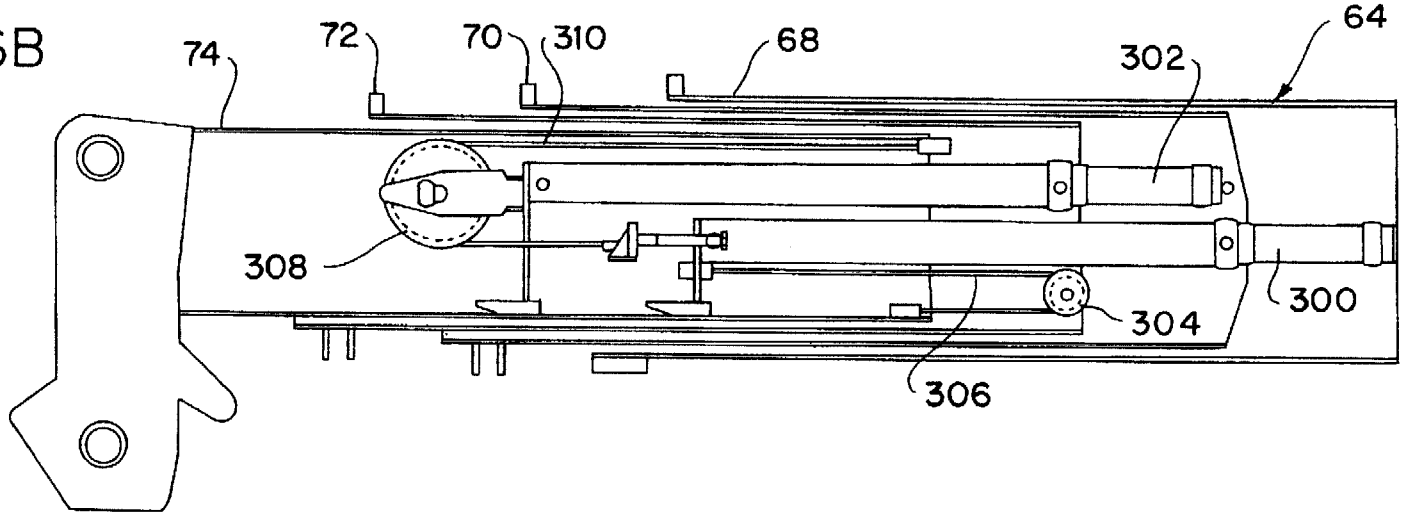

As illustrated in FIG. 6B, the upper boom 64 includes a telescoping mechanism whereby the various boom sections are telescopically movable relative to each other by hydraulic cylinder/piston assemblies mounted inside the upper boom 64 between the respective boom sections, in a conventional manner, or by other conventional boom extension mechanisms. As shown in FIG. 6B, the telescoping mechanism for the upper boom 64 includes a first single stage telescoping cylinder 300 connected to the base section 68 and the inner mid section 70. The telescoping mechanism for the upper boom 64 also includes a second single stage telescoping cylinder 302 connected to the inner mid section 70 and the outer mid section 72. An extension sheave 308 is mounted to the second cylinder 302, and an extension cable 310 therefor is anchored to the fly section 74 and the first telescoping cylinder 300. A retraction sheave 304 is mounted on the inner mid section 70, and a retraction cable 306 therefor is anchored to the fly section 74 and a sliding support for the first telescoping cylinder 300.

During operation, the first telescoping cylinder 300 extends and retracts to extend and retract the inner mid section 70. The second telescoping cylinder 302 extends and retracts to extend and retract the outer mid section 72. The extension sheave and cable 308, 310 cause the fly section 74 to extend synchronously with the extension of the outer mid section 72, while the retraction sheave and cable 304, 306 cause the fly section 74 to retract synchronously with the retraction of the outer mid section 72.

A riser boom hoist 76 is disposed on the upper boom 64. As particularly shown in FIGS. 10 and 11, the riser boom hoist 76 controls the deployment of a lift cable 77 supported by sheaves at 79 and 81 on the end of the riser boom 56 and connected to control a load carrying hook assembly 83 or other well known load carrying device.

Figure 12:
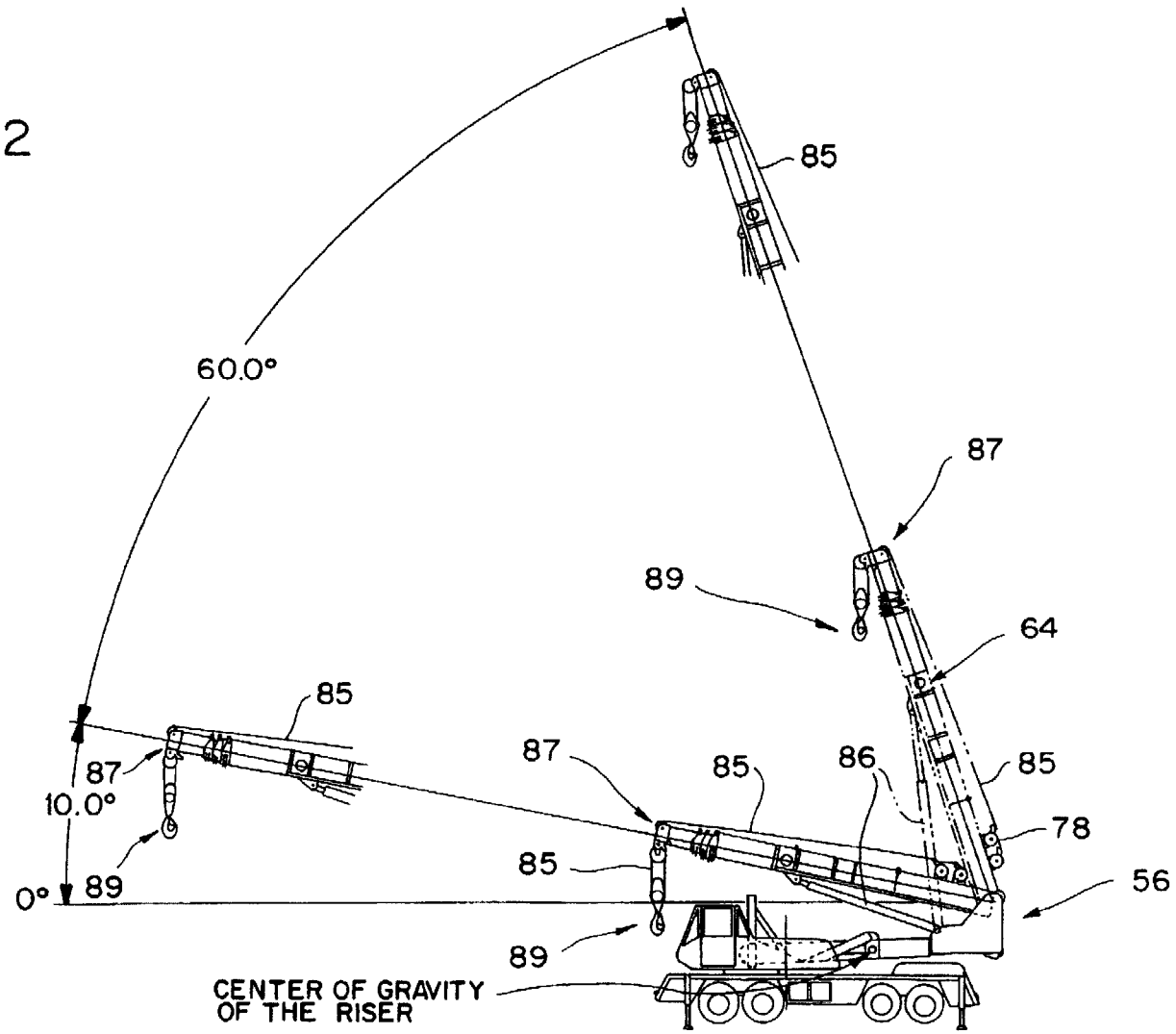
FIGS. 12–14 illustrate possible upper boom position for different riser boom positions when the upper boom supports a load.
Figure 13:
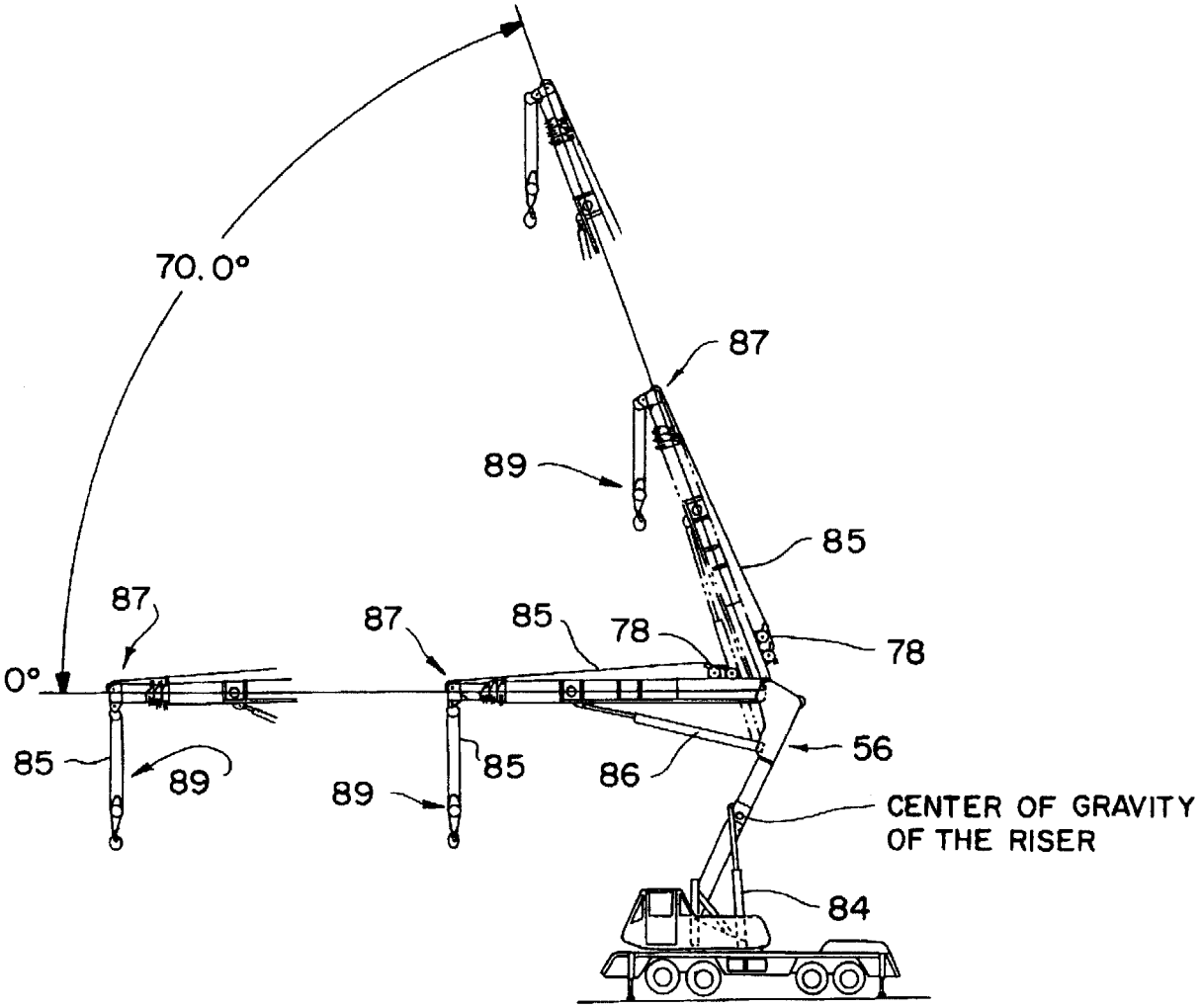
Figure 14:
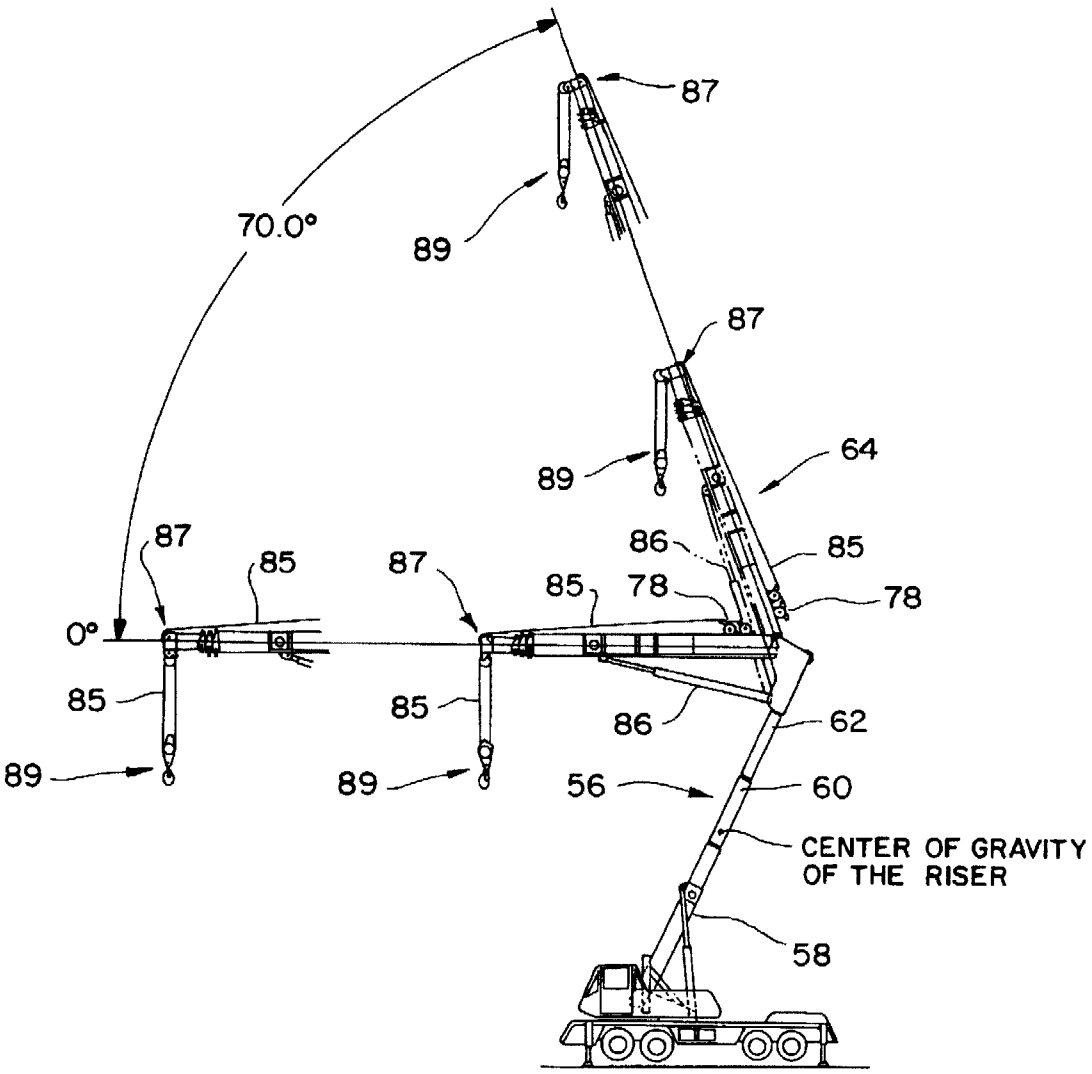

Disposed on the upper boom 64 adjacent to the riser boom hoist 76 is an upper boom hoist 78. As shown in FIGS. 12, 13, and 14, the upper boom hoist 78 controls the deployment of a lift cable 85 supported by boom nose assembly 87 on the terminal end of the upper boom 64 and connected to a load carrying hook assembly 89 or other well known load carrying device.

An operators cab 82 is connected to the turntable 54 and includes the controls for the crane. The operators cab 82 is a rotatable cab, and may be rotated to face either end of the chassis 50. The controls for the crane are conventional controls and include an electronic load moment indicator (LMI) system 100. The LMI system 100 has been programmed to assist the operator in maintaining the crane within certain empirically determined operating limits discussed in detail below. As one skilled in the art knows, conventional LMI systems monitor the operating characteristics of the crane, such as boom angles, boom lengths, and loads thereon, and warn the operator that the crane is achieving unwanted operating characteristics. For instance, the LMI system assists the crane operator by warning the operator when lifting a load in a manner which would cause the crane to tip over. The LMI system 100 of the present invention operates in the same manner except that the operating characteristics are significantly different from conventional cranes. In a preferred embodiment, the LMI system 100 of the present invention is a DS350G made by PAT Equipment Corporation, Inc. programmed to assist the operator in maintaining the crane within the empirically determined operating limits discussed in detail below.

In designing the crane according to the present invention, the inventors determined that the following factors influence the center of gravity for the crane when lifting a load (i.e. the combined center of gravity of the chassis 50, the riser boom 56, the upper boom 64 and the load being lifted): the length and weight of the riser boom 56, the length and weight of the upper boom 64, the distance between the front and rear outriggers 52 on either end of the chassis 50, the extension lengths of the outriggers, the distances from the center axis of rotation 55 to the outriggers 52 on either end of the chassis 50 (which determines the riser boom pivot connection 57 with respect to the outriggers 52), the weight of the chassis 50, the angle between the riser boom 56 and chassis 50 when level (the riser boom angle), the angle between the upper boom 64 and the chassis 50 when level (the upper boom angle), the mass of the load being supported and which of the riser boom 56 and the upper boom 64 supports the load. As one skilled in the art will note, some of these factors are variable operating characteristics of the crane.

The inventors then determined that if they could design the crane such that the center of gravity for the crane remained within the ground engaging outriggers 52 on either side of the chassis 50 during a lifting operation, no counterweight would be needed during the lifting operation. Furthermore, the inventors realized by disposing the riser boom 56 and upper boom 64 to point in opposite directions with respect to the center of rotation 55 that (1) during a riser boom lifting operation, the upper boom 64 serves as a counterweight, and (2) during an upper boom lifting operation the riser boom 56 serves as a counterweight. Namely, when lifting a load with the riser boom 56, the center of gravity for the riser boom 56 acts to shift the center of gravity for the crane in one direction. The center of gravity of the upper boom 64 has the opposite effect. Therefore, by maintaining operating characteristics of the crane (e.g., riser and upper boom angles, etc.) within empirically determined limits via the LMI system, the center of gravity for the crane could be maintained within the area subscribed by the ground engaging outriggers 52. Likewise, similar limits can be set when using the upper boom 64 as the lifting boom such that the riser boom 56 serves as a counterweight.

Through empirical design, the inventors set the above factors such that the center of gravity for the crane is maintained within the outriggers 52 on either end of the chassis 50. For those factors which are variable operating characteristics of the crane, operating ranges were empirically determined. For example, ranges of riser boom and upper boom angles when lifting various weight loads at various lift radii, and at various lift heights were empirically determined. The LMI system is then programmed with the empirically determined limits on the operating characteristics. As one skilled in the art will readily appreciate, based on the forgoing disclosure one skilled in the art can empirically determine the above discussed factors to develop a crane meeting desired operating characteristics without undue experimentation.

Since the center of gravity of the crane according to the present invention remains within the outriggers 52, the crane according to the present invention does not need a counterweight. As a result, the crane according to the present invention has no tail swing. As an added benefit the crane is considerably lighter than conventional cranes which perform the same lifting operation so it has a lighter per axle load for road travel.

Furthermore, the rating of a crane according to the present invention could easily be increased through the addition of a fixed counterweight.

Figure 10:
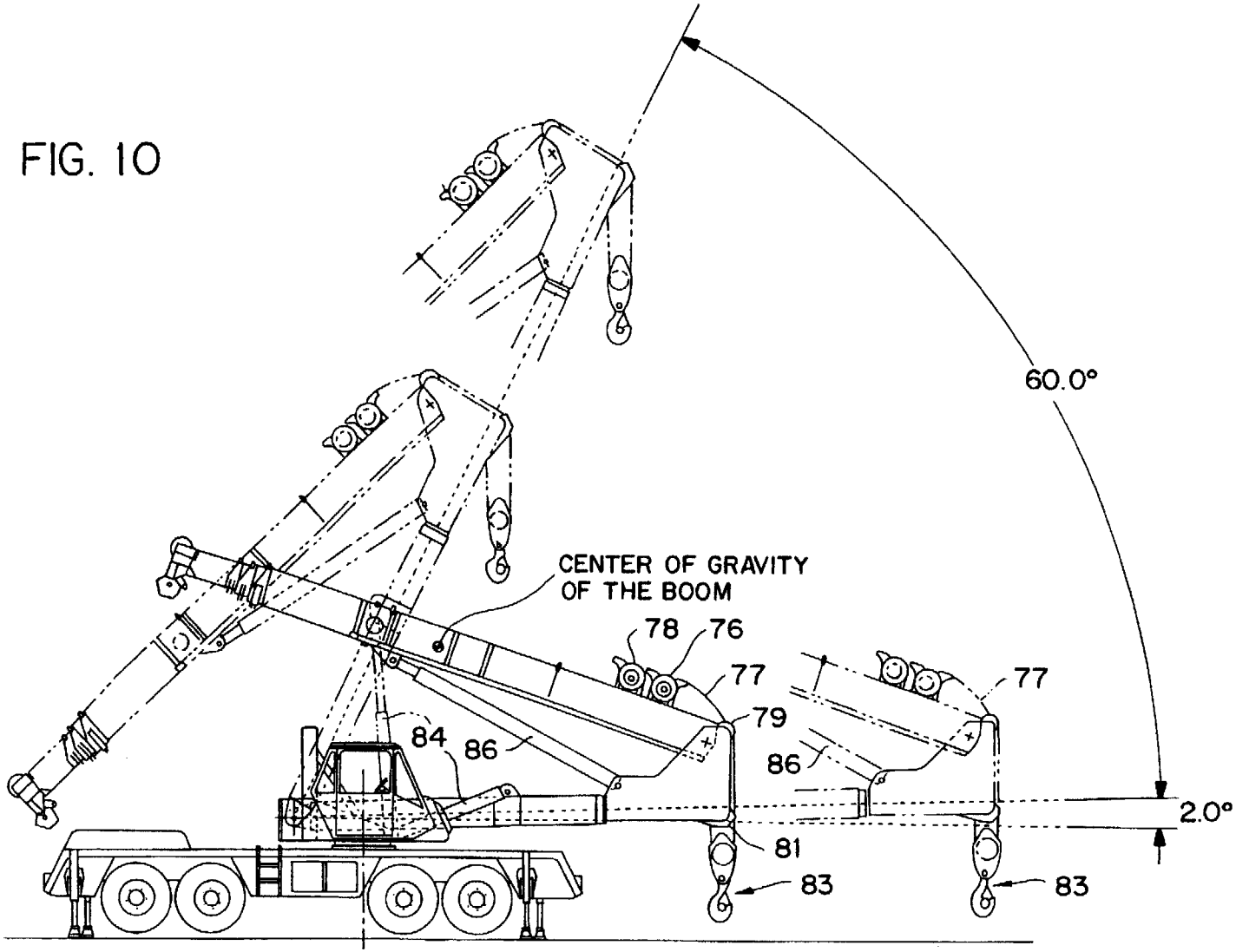
FIG. 10 illustrates possible riser boom positions when the riser boom supports a load.

Next, the operation of the crane according to the present invention will be discussed with respect to FIGS. 10–14. FIG. 10 illustrates possible riser boom positions when the riser boom 56 supports a load. As shown in FIG. 10, the riser boom hoist 76 controls the deployment of a cable 77 connected to a load carrying hook 83. As illustrated in FIG. 10, the riser boom 56 can be elevated by the riser boom elevation cylinder 84 though a plurality of riser boom angles. While FIG. 10 illustrates the riser boom 56 being moved from its substantially horizontal stowed position of a 2 degree riser boom angle to a 60 degree riser boom angle, the riser boom 56 can achieve any riser boom angle less than or equal to 90 degrees, but greater than 2 degrees.

The 2 degree limit on the riser boom angle has been set to permit the upper boom 64 to clear the operators cab 82 when the riser boom 56 and the upper boom 64 are in their stowed positions, and to provide a slight riser boom angle so the lift cylinder 84 has a more vertical component of force to more easily lift the riser boom 56. One skilled in the art will readily understand from this disclosure that the crane according to the present invention could be modified to achieve a zero degree riser boom angle.

As further shown, the upper boom 64 is maintained at a minimum angle with respect to the riser boom 56, when the riser boom 56 is the lifting boom. This minimum angle permits the upper boom 64 to clear the operators cab 82 when the riser boom 56 is used as the lifting boom. Also, maintaining the riser boom 56 at this minimum angle maximizes the counterweighting effect of the riser boom 56.

Figure 11:
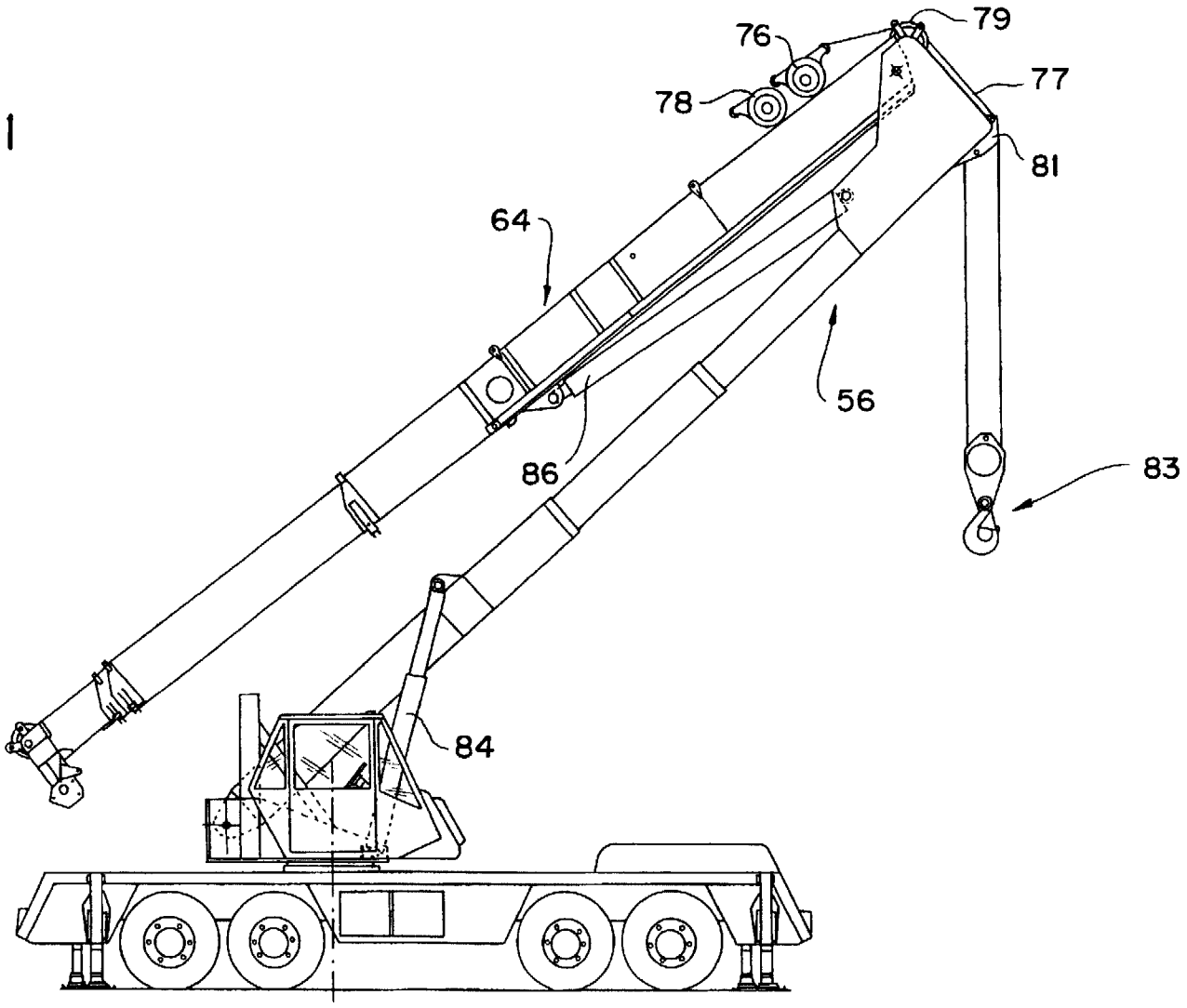
FIG. 11 illustrates the extension of the upper boom to provide a greater counterweight effect when using the riser boom to support a load.

Furthermore, as shown in FIG. 11, during a riser boom lifting operation, one or more sections of the upper boom 64 can be extended to further shift the center of gravity for the upper boom 64 and increase the counterweight effect of the upper boom 64 with respect to the riser boom 56. Of course, the angle between the upper boom 64 and the riser boom 56 would have to be set such that the extending upper boom 64 would not contact the chassis 50, and the amount of extension would be limited to the distance from the end of the upper boom 64 to the ground. As one skilled in the art will appreciate, control of this extension operation could be programmed into the LMI system 100.

FIG. 12 illustrates various possible positions of the upper boom 64 when the riser boom 56 is in its stowed position and the upper boom 64 supports a load. As shown in FIG. 12, the upper boom hoist 78 controls the deployment of a cable 85 supported by the upper boom 64 and connected to a load carrying hook 89. As further illustrated in FIG. 12, the upper boom 64 can be elevated by the upper boom elevation cylinder 86 through a plurality of upper boom angles. While FIG. 12 illustrates the upper boom 64 being moved from a 10 degree upper boom angle to a 60 degree upper boom angle, the upper boom 64 can achieve any upper boom angle between 10 and 90 degrees which maintains the center of gravity for the crane within the outriggers 52. The 10 degree lower limit for the upper boom angle has been set to permit the upper boom 64 to clear the operators cab 82. One skilled in the art will readily understand from this disclosure that the crane according to the present invention could be modified to achieve upper boom angles less than 10 degrees.

FIGS. 13 and 14 are similar to FIG. 12, except that FIG. 13 illustrates the riser boom 56 elevated and retracted, and FIG. 14 illustrates the riser boom 56 elevated and extended. While FIGS. 13 and 14 illustrates the upper boom 64 being moved from a 0 degree upper boom angle to a 70 degree upper boom angle, the upper boom 64 can achieve any upper boom angle less than or equal to 90 degrees which maintains the center of gravity for the crane within the outriggers 52. Furthermore, while FIGS. 13 and 14 show the riser boom 56 at a particular riser boom angle, the riser boom angle can be varied so long as the center of gravity for the crane remains within the outriggers 52.

Figure 1:
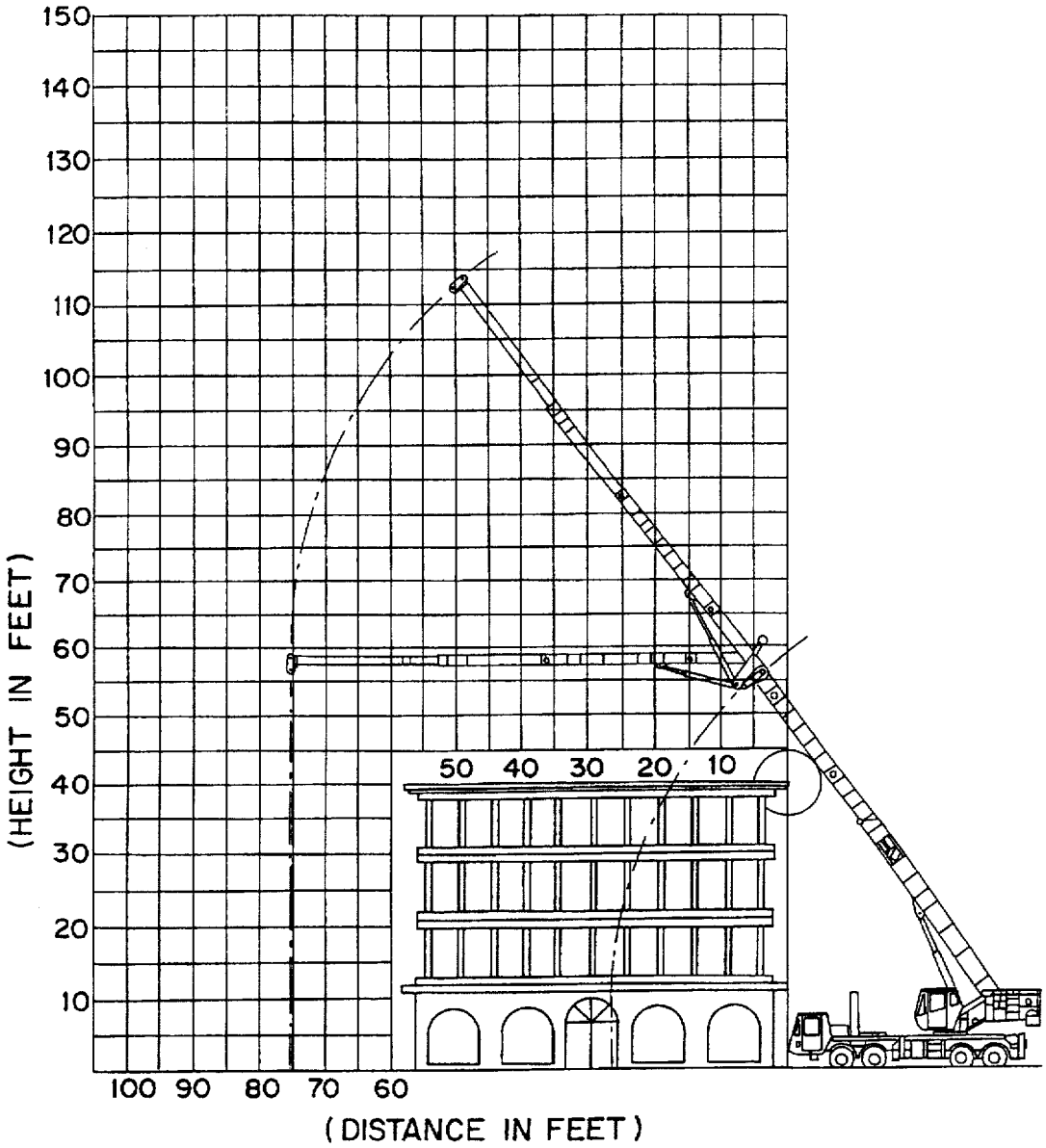
FIG. 1 illustrates a conventional crane performing an up and over lift.
Figure 2A:
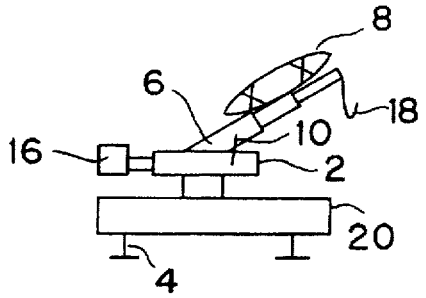
FIGS. 2a–4 are schematic diagrams illustrating conventional crane configurations.
Figure 2B:
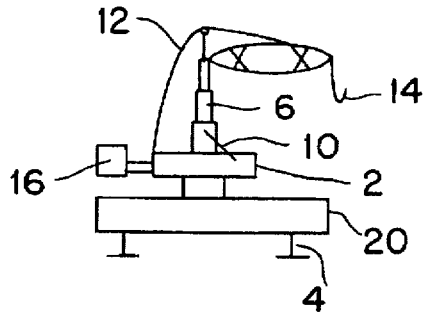
Figure 3:
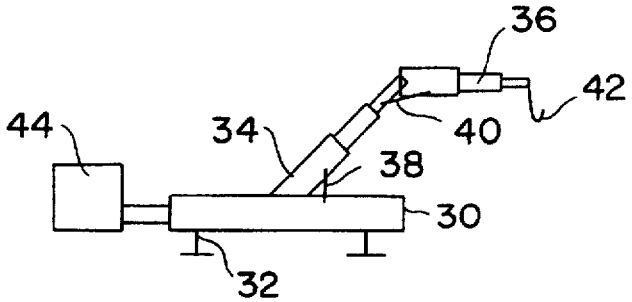
Figure 4:
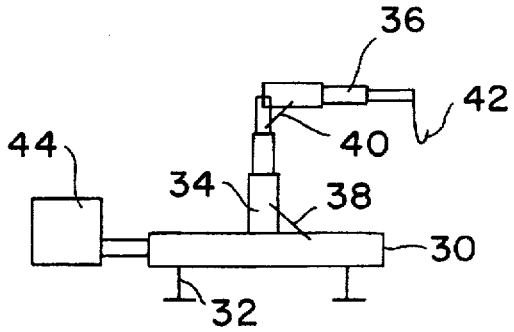
Figure 15:
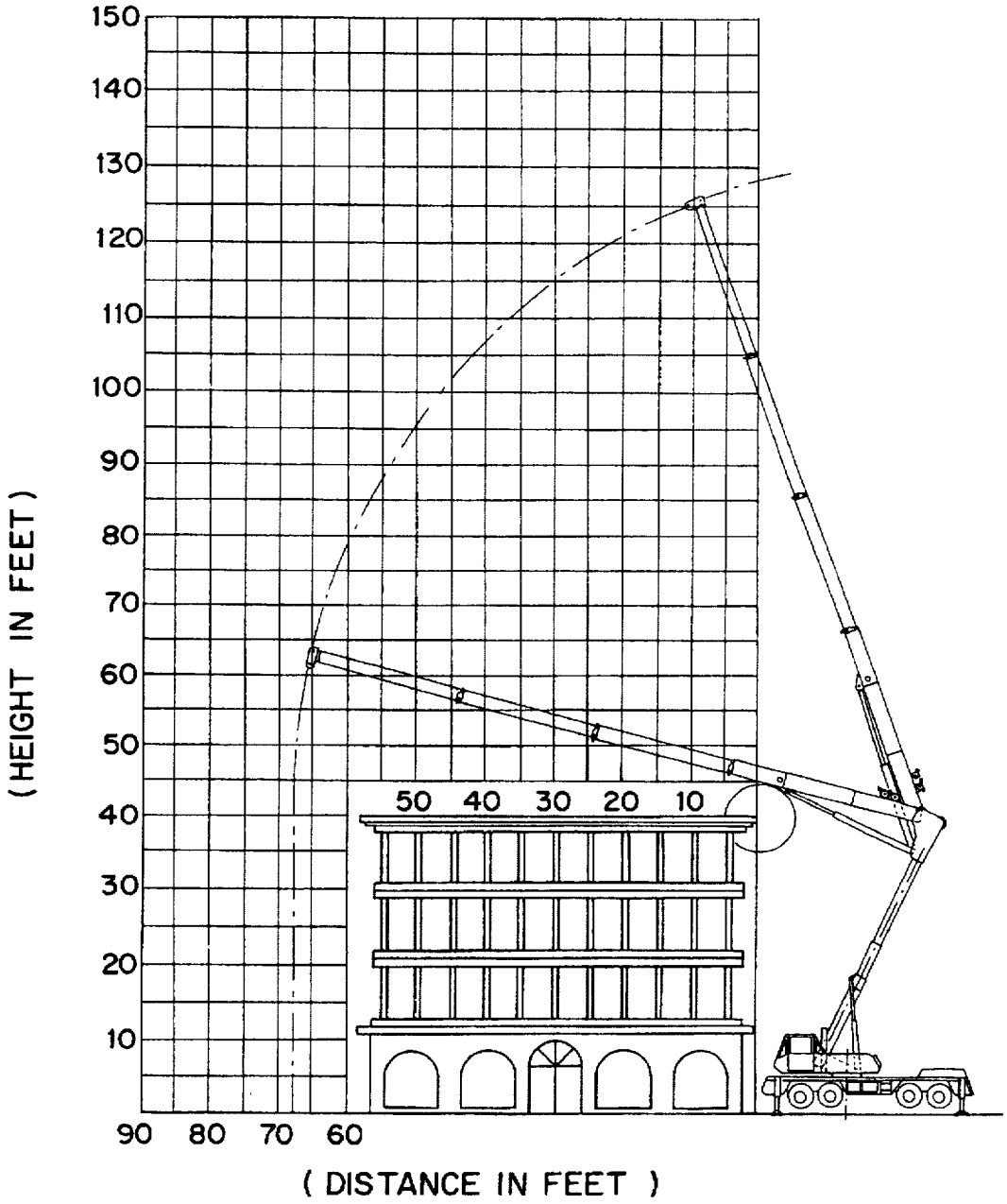
FIG. 15 illustrates the crane of the present invention performing the same up and over lift as illustrated with respect to a convention crane in FIG. 1.

FIG. 15 illustrates a crane according to the present invention performing the same up and over lift illustrated in FIG. 1. The crane according to the present invention, however, only needs to have a rating of 40 tons to perform the same lift due to the unique arrangement of the upper boom 64 with respect to the riser boom 56. Furthermore, since no counterweight is needed, the crane according to the present invention has significantly less tail swing than the conventional crane.

Since, according to the present invention, a much smaller crane can perform the same lift as a much larger conventional crane and in less space, the crane according to the present invention may meet space constraints which prohibited positioning the conventional crane. Additionally, the lighter crane according to the present invention is more likely to be able to access the work site, and satisfy road weight requirements.

While the invention has been described in connection with what is presently considered the most practical and preferred embodiments, it is to be understood that the invention is not limited to the disclosed embodiments, but on the contrary, is intended to cover various modifications and equivalent arrangements included within the spirit and scope of the appended claims.

What is claimed:

1. A transportable multi-purpose crane, comprising:

a platform having outriggers disposed at opposite ends;

a turntable rotatably mounted to said platform between said outriggers on opposite ends of said platform and having a center axis of rotation;

a riser boom having a first end and a second end, said first end being pivotably mounted to said turntable, said second end supporting a first load carrying means, said riser boom pointing in a first direction with respect to said center axis of rotation, said riser boom being a telescoping boom;

an upper boom having a first end and a second end, said first end being pivotably mounted to said second end of said riser boom, said second end supporting a second load carrying means, said upper boom pointing in a second direction, opposite said first direction, with respect to said center axis of rotation when a load is supported from said first load carrying means and when a load is supported from said second load carrying means, and said upper boom being a telescoping boom.

2. The crane of claim 1, further comprising:

control means for prohibiting said crane from exceeding specified operating ranges.

3. The crane of claim 2, wherein said control means prevents said riser boom from pivoting to a point where said second end thereof crosses said center of rotation when using said second load carrying means to carry a load.

4. The crane of claim 2, wherein said control means prohibits said riser boom from achieving an angle with respect to said platform of greater than or equal to 90 degrees when using said second load carrying means to carry a load.

5. The crane of claim 2, wherein said control means controls said riser boom and said upper boom such that a combined center of gravity including said riser boom, said upper boom, and said platform remains within said outriggers on opposite ends of said platform such that said crane does not need a separate counterweight.

6. The crane of claim 5, wherein said crane does not include a separate counterweight.

7. The crane of claim 2, wherein said control means controls said riser boom and said upper boom such that a combined center of gravity including said riser boom, said upper boom, said platform and a load carried by said first load carrying means remains within said outriggers on opposite ends of said platform such that said crane does not need a separate counterweight.

8. The crane of claim 7, wherein said crane does not include a separate counterweight.

9. The crane of claim 2, wherein said control means controls said riser boom and said upper boom such that a combined center of gravity including said riser boom, said upper boom, said platform and a load carried by said second load carrying means remains within said outriggers on opposite ends of said platform such that said crane does not need a separate counterweight.

10. The crane of claim 9, wherein said crane does not include a separate counterweight.

11. The crane of claim 2, wherein said control means controls said riser boom and said upper boom so that said riser boom serves as a counterweight when said second load carrying means carries a load such that said crane does not need a separate counterweight.

12. The crane of claim 11, wherein said crane does not include a separate counterweight.

13. The crane of claim 11, wherein said control means controls said riser boom and said upper boom so that said upper boom serves as a counterweight when said first load carrying means carries a load such that said crane does not need a separate counterweight.

14. The crane of claim 13, wherein said control means extends said upper boom to increase said counterweighting.

15. The crane of claim 13, wherein said crane does not include a separate counterweight.

16. The crane of claim 2, wherein said control means controls said riser boom and said upper boom so that said upper boom serves as a counterweight when said first load carrying means carries a load such that said crane does not need a separate counterweight.

17. The crane of claim 16, wherein said crane does not include a separate counterweight.

18. The crane of claim 1, wherein said riser boom creates a riser boom angle with respect to said platform, said riser boom angle being less than 90 degrees.

19. The crane of claim 1, wherein a combined center of gravity including said riser boom, said upper boom, and said platform remains within said outriggers on opposite ends of said platform such that said crane does not need a separate counterweight.

20. The crane of claim 19, wherein said crane does not include a separate counterweight.

21. The crane of claim 1, wherein a combined center of gravity including said riser boom, said upper boom, said platform and a load carried by said first load carrying means remains within said outriggers on opposite ends of said platform such that said crane does not need a separate counterweight.

22. The crane of claim 21, wherein said crane does not include a separate counterweight.

23. The crane of claim 1, wherein a combined center of gravity including said riser boom, said upper boom, said platform and a load carried by said second load carrying means remains within said outriggers on opposite ends of said platform such that said crane does not need a separate counterweight.

24. The crane of claim 23, wherein said crane does not include a separate counterweight.

25. The crane of claim 1, wherein said riser boom serves as a counterweight when said second load carrying means carries a load such that said crane does not need a separate counterweight.

26. The crane of claim 25, wherein said crane does not include a separate counterweight.

27. The crane of claim 25, wherein said upper boom serves as a counterweight when said first load carrying means carries a load such that said crane does not need a separate counterweight.

28. The crane of claim 27, wherein said crane does not include a separate counterweight.

29. The crane of claim 1, wherein said upper boom serves as a counterweight when said first load carrying means carries a load such that said crane does not need a separate counterweight.

30. The crane of claim 29, wherein said upper boom extends to increase said counterweighting.

31. The crane of claim 29, wherein said crane does not include a separate counterweight.

32. The crane of claim 1, further comprising:

a separate fixed counterweight to increase a rating of said crane.

33. The crane of claim 1, wherein said riser boom has a base section, mid section and fly section; and said upper boom has a base section, inner mid section, outer mid section and fly section.

* * * * *